US007581800B2

(12) United States Patent
Tanaka et al.

(10) Patent No.: US 7,581,800 B2
(45) Date of Patent: Sep. 1, 2009

(54) SYSTEM FOR SCANNING RECYCLED PAPER BEFORE PRINTING

(75) Inventors: Tomoyuki Tanaka, Concord, CA (US); Arthur E. Alacar, Concord, CA (US)

(73) Assignees: Kyocera Mita Corporation, Chuo-ku, Osaka-shi, Osaka (JP); Kyocera Technology Development, Inc., Concord, CA (US)

( * ) Notice: Subject to any disclaimer, the term of this patent is extended or adjusted under 35 U.S.C. 154(b) by 458 days.

(21) Appl. No.: 11/281,752

(22) Filed: Nov. 17, 2005

(65) Prior Publication Data

US 2007/0109349 A1 May 17, 2007

(51) Int. Cl.
*B41J 29/38* (2006.01)

(52) U.S. Cl. ..... 347/14; 347/4; 347/2; 400/76

(58) Field of Classification Search ..... 347/14, 347/4, 2; 400/76

See application file for complete search history.

(56) References Cited

U.S. PATENT DOCUMENTS

| | | | | |
|---|---|---|---|---|
| 5,349,377 | A | 9/1994 | Gilliland | |
| 5,459,556 | A | 10/1995 | Acquaviva | |
| 6,236,831 | B1 | 5/2001 | Mei | |
| 6,297,796 | B1 | 10/2001 | Letts | |
| 6,580,433 | B2 | 6/2003 | Abe | |
| 6,891,640 | B2 | 5/2005 | Kakikawa | |
| 2004/0001131 | A1 * | 1/2004 | Huang et al. | 347/101 |

FOREIGN PATENT DOCUMENTS

| | | |
|---|---|---|
| JP | 10175345 | 6/1998 |
| JP | 2000255909 | 9/2000 |

OTHER PUBLICATIONS

U.S. Appl. No. 11/201,988, filed Feb. 15, 2007, Tanaka.

* cited by examiner

*Primary Examiner*—Stephen D Meier
*Assistant Examiner*—Ly T Tran

(57) ABSTRACT

A system for printing to recycled paper sheets, by scanning a sheet for existing marks, comparing them with the intended output, and printing upon determining the suitability of printing the intended output to the sheet. When recycled paper is used for printing, the intended output is sometimes printed on the wrong side of the sheet, resulting in wasted paper, toner, and other resources. This system avoids printing to the wrong side of sheets, and enables adjustment of intended output for better result. Sheets can be reversed, rotated, and discarded, and the intended output can be adjusted by shrinking, moving, and rotating. Methods also include previewing the output and the existing marks together, low-resolution processing, printing shading patterns on existing marks, rearranging scaled-down pages of N-up printing, Duplex support, collision detection with user-customizable, threshold overlap value and separation distance, and estimating separation distance by boundary-augmentation of alternating 4- and 8-neighbors.

18 Claims, 9 Drawing Sheets

SYSTEM FOR SCANNING RECYCLED PAPER BEFORE PRINTING

CROSS-REFERENCES TO RELATED APPLICATIONS

Not Applicable

FEDERALLY SPONSORED RESEARCH

Not Applicable

SEQUENCE LISTING OR PROGRAM

Not Applicable

FIELD OF THE INVENTION

This invention relates to processing of print images, and more particularly to methods for scanning recycled paper before printing on it.

BACKGROUND OF THE INVENTION

Device drivers are generally known, including a printer driver. Typically, printing from a computer occurs through the use of a printer driver. Upon either an application launch or during a print command load time, the application will call an instance of the printer driver. When recycled paper is used for printing, sometimes the intended output is printed on the wrong side of the sheet. This results in wasted paper, toner, and other resources. What is wanted is a flexible and efficient way to address the problems that arise when recycled paper is used for printing. The present invention arose out of the above concerns associated with processing of print images and detecting and avoiding printing of solid black areas in pages.

SUMMARY OF THE INVENTION

Methods, computer program products, computing and printing systems for printing to recycled paper sheets, by scanning a sheet for existing marks, comparing them with the intended output, and printing upon determining the suitability of printing the intended output to the sheet are described. When recycled paper is used for printing, sometimes the intended output is unexpectedly printed on the wrong side of the sheet. This results in wasted paper, toner, and other resources. This system avoids printing to the wrong side of recycled sheets, and enables adjustment of intended output for better result. Sheets can be reversed, rotated, and discarded; and the intended output can be adjusted by shrinking, moving, and rotating. Methods also include previewing the output and the existing marks together, low-resolution processing, printing shading patterns on existing marks, rearranging scaled-down pages of N-up printing, Duplex support, collision detection with user-customizable, threshold overlap value and separation distance, and estimating separation distance by boundary-augmentation of alternating 4- and 8-neighbors. The method is especially useful for expensive paper or sheet-like medium, for which wasting sheets is costly.

In an embodiment of the invention, previewing allows a user to see the intermediate results of the various conversion methods available. When the user is satisfied for "System for scanning recycled paper before printing" with the appearance of the print page, the user can click on the [Print] button to initiate printing. The user can click on the [Cancel] button to cancel printing of the page.

The invention will be more fully understood upon consideration of the detailed description below, taken together with the accompanying drawings.

DETAILED DESCRIPTION OF THE INVENTION

In the following detailed description, numerous specific details are set forth in order to provide a thorough understanding of the present invention. However, it will be apparent to one of ordinary skill in the art that these specific details need not be used to practice the present invention. In other instances, well known structures, interfaces, and processes have not been shown in detail in order not to unnecessarily obscure the present invention.

Figure 1:
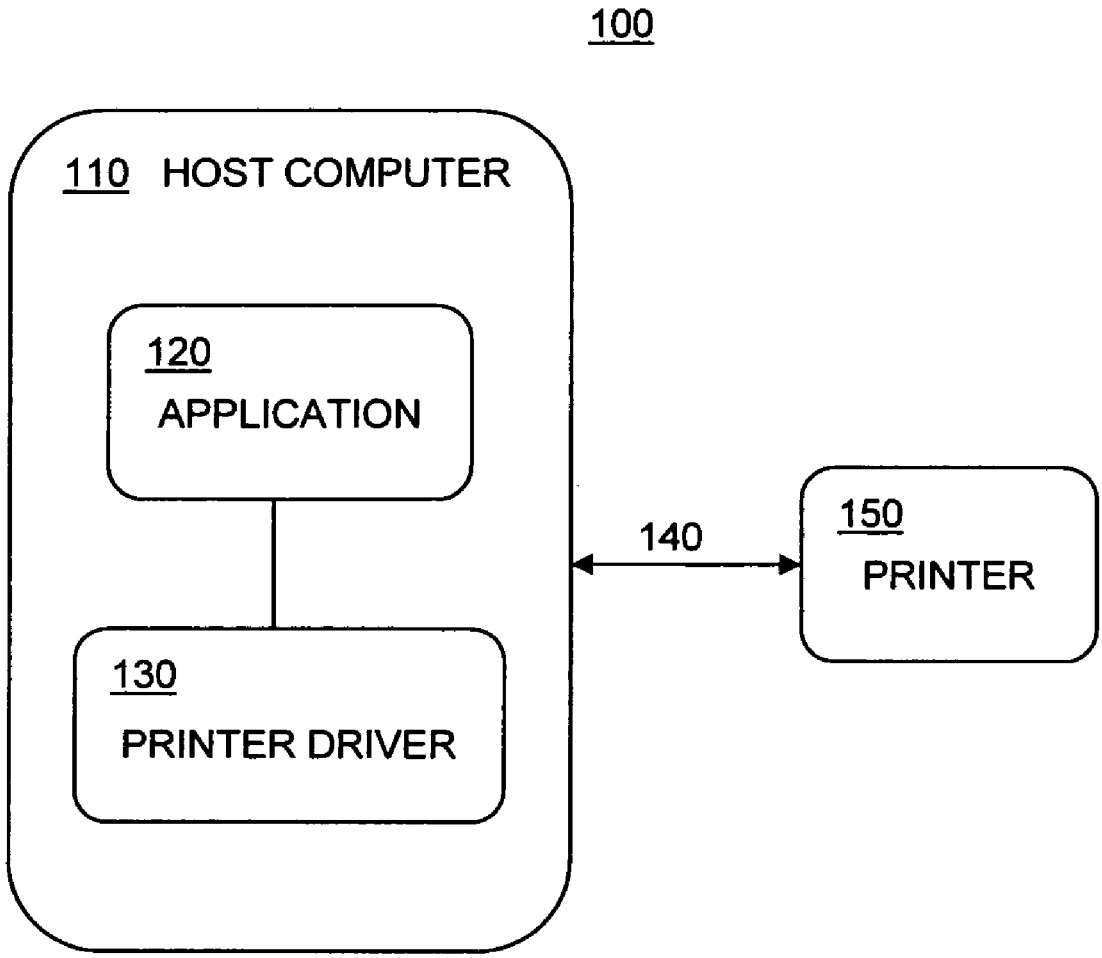
FIG. 1 is a simplified block diagram showing connection of a computing system to a printer.

FIG. 1 shows a general printing system setup 100 that includes a host computer 110 and a printer 150. Here, the printer 150 may be any device that can act as a printer, e.g. an inkjet printer, a laser printer, a photo printer, or an MFP (Multifunction Peripheral or Multi-Functional Peripheral) that may incorporate additional functions such as faxing, facsimile transmission, scanning, and copying.

The host computer 110 includes an application 120 and a printer driver 130. The application 120 refers to any computer program that is capable of issuing any type of request, either directly or indirectly, to print information. Examples of an application include, but are not limited to, commonly used programs such as word processors, spreadsheets, browsers and imaging programs. Since the invention is not platform or machine specific, other examples of application 120 include any program written for any device, including personal computers, network appliance, handheld computer, personal digital assistant, handheld or multimedia devices that is capable of printing.

The printer driver 130 is a software interfacing with the application 120 and the printer 150. Printer drivers are generally known. They enable a processor, such as a personal computer, to configure an output data from an application that will be recognized and acted upon by a connected printer. The output data stream implements necessary synchronizing actions required to enable interaction between the processor and the connected printer. For a processor, such as a personal computer, to operate correctly, it requires an operating system such as DOS (Disk Operating System) Windows, Unix, Linux, Palm OS, or Apple OS.

A printer I/O (Input/Output) interface connection 140 is provided and permits host computer 110 to communicate with a printer 150. Printer 150 is configured to receive print commands from the host computer and, responsive thereto, render a printed media. Various exemplary printers include laser printers that are sold by the assignee of this invention. The connection 140 from the host computer 110 to the printer 150 may be a traditional printer cable through a parallel interface connection or any other method of connecting a computer to a printer used in the art, e.g., a serial interface connection, a remote network connection, a wireless connection, or an infrared connection. The varieties of processors, printing systems, and connection between them are well known.

The present invention is suited for printer drivers, and it is also suited for other device drivers. The above explanations regarding FIG. 1 used a printer driver rather than a general device driver for concreteness of the explanations, but they also apply to other device drivers. Similarly, the following descriptions of the preferred embodiments generally use, examples pertaining to printer driver, but they are to be understood as similarly applicable to other kinds of device drivers.

Figure 2:
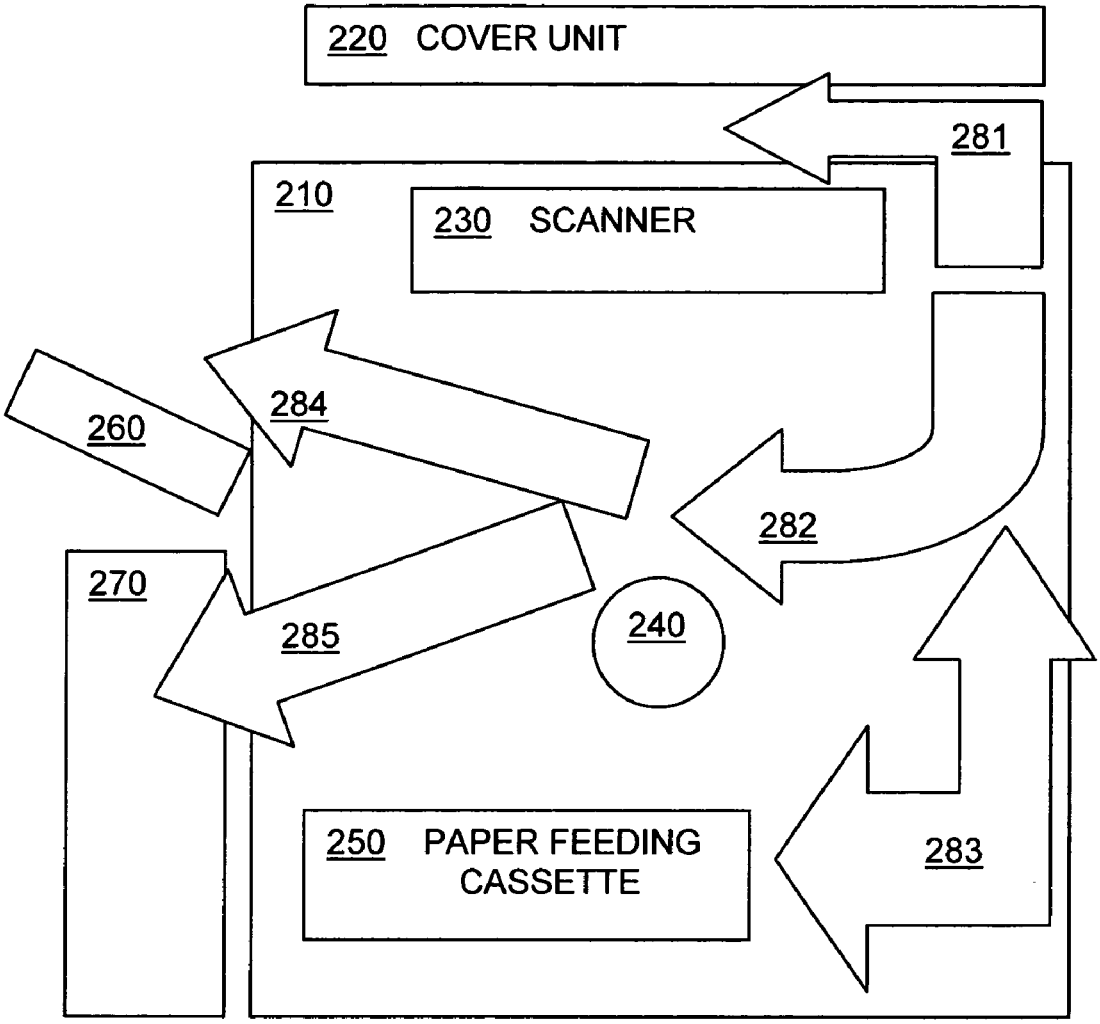
FIG. 2 is a block diagram of an exemplary printing system employing principles of the present invention.

FIG. 2 is a block diagram of an exemplary printing system employing principles of the present invention. The arrows in the diagram represent movement and delivery of the sheets of paper. The printer or MFP 210 contains a Scanner 230 for scanning and copying. The scanning surface is covered by the attached cover unit 220. Also attached is a Waste paper bin or Shredder 270.

For ordinary copying, a document is placed face-down on the scanning surface, with the cover unit 220 down. A sheet of paper is taken from the Paper feeding cassette 250 and delivered upward 283, 282 to Thermal print head (not shown) and Platen roller 240. The scanned image is then printed on the sheet of paper and delivered 284 to the Paper output tray or guide 260. Similarly, for ordinary printing, a sheet of paper is taken from the Paper feeding cassette 250 and delivered upward 283, 282 to the Thermal print head (not shown) and the Platen roller 240. The intended print output is then printed on the sheet of paper and delivered 284 to the Paper output tray or guide 260.

In an embodiment of the present invention in which a sheet of paper is scanned for existing marks before printing, a sheet of paper is taken from the Paper feeding cassette 250 and delivered upward 283, 281 to the scanning surface, then is taken down 282 to the Platen roller 240 for printing. Depending on the existing marks detected on the paper, the sheet may be rotated and/or reversed before printing 282. Also, depending on the existing marks detected on the paper, the sheet may be brought back to the Paper feeding cassette 250 or it may be brought 285 to the Waste paper bin 270, which may also include a Shredder 270 for security.

Other configurations are also possible in other embodiments of the invention. In an embodiment the Scanner 230 can be a separate unit housed outside of the main unit 210. In another embodiment the Host Computer, PC, or CPU (not shown) that is responsible for processing and analysis of the scanned image can be embedded in the main unit 210.

Figure 3:
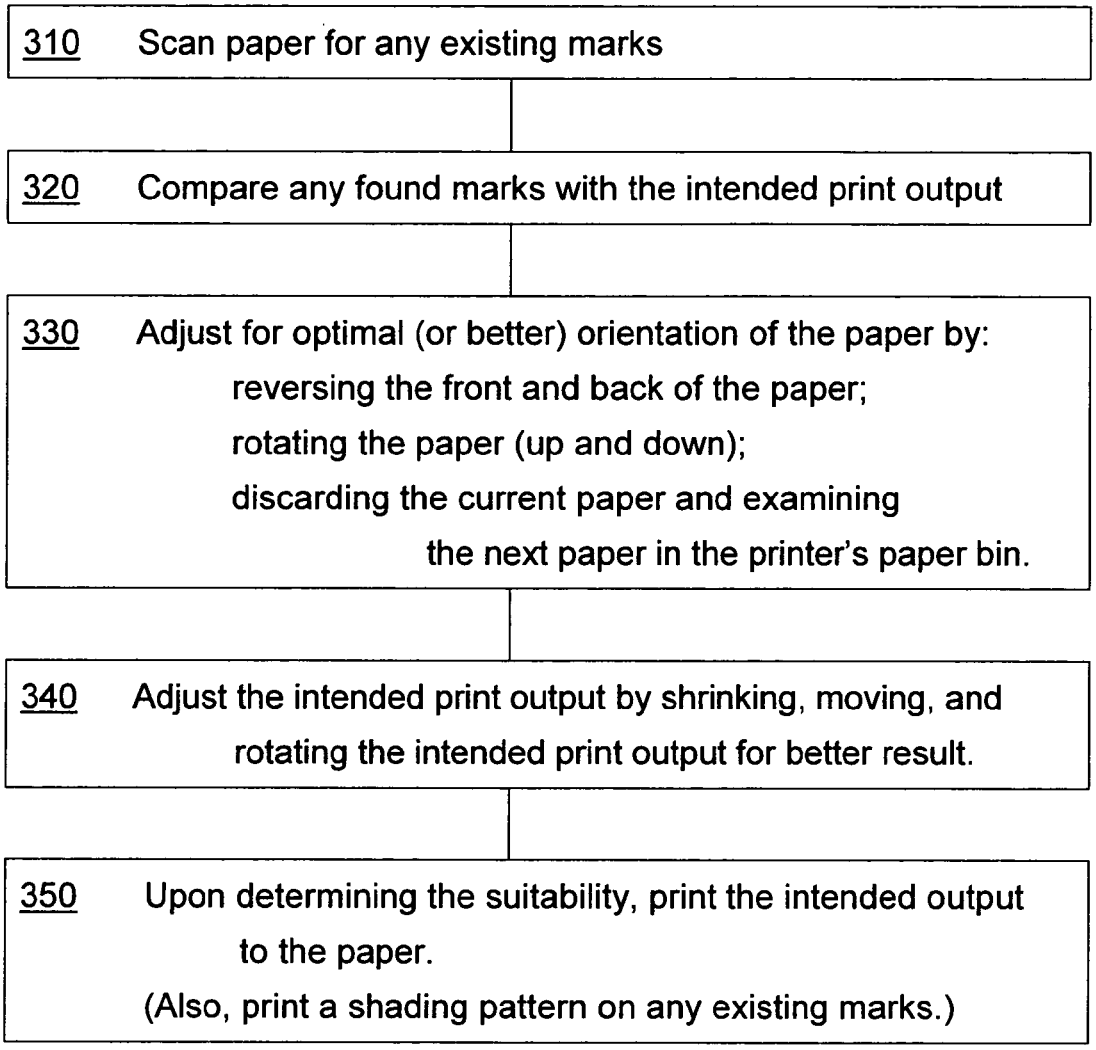
FIG. 3 is a flowchart showing the overall procedure of scanning recycled paper before printing on it, in accordance with a preferred embodiment of the present invention.

FIG. 3 is a flowchart showing the overall procedure of scanning recycled paper before printing on it, in accordance with a preferred embodiment of the present invention. In step 310, a sheet of paper is scanned for any existing marks. Then in step 320, a comparison is made between the any found marks and the intended print output. More details of the kinds of comparisons made are described later.

In step 330, an optimal (or better) orientation of the paper is analyzed, and depending on the result of the analysis, an adjustment is made on the orientation of the paper. This adjustment includes reversing the front and back of the paper, and then examining the reverse, unexamined side of the paper; rotating the paper (up and down); and discarding the current paper and examining the next paper in the printer's paper bin.

In step 340, an adjustment is made on the intended print output by shrinking, moving, and rotating the intended print output for better result. This may involve further analysis of collision detection and separation distance detection. These processes are described later in greater detail.

In step 350, when the optionally-adjusted intended print output is determined to be suitable for printing on the optionally-adjusted sheet of paper, the intended output is printed onto the paper. In an embodiment of the invention, a shading pattern is printed on top to cover the any existing marks, in order to make clear which parts are newly printed outputs. Shading patterns are intended to obscure the existing marks and can be a series of diagonal lines. In a further embodiment, the shading patterns include fine-print or stylized identification information encoding current date and time, job name, job owner name, etc. In a yet further embodiment, unnecessary shading patterns are not printed, for example, on top of previously-shaded regions.

Figure 4:
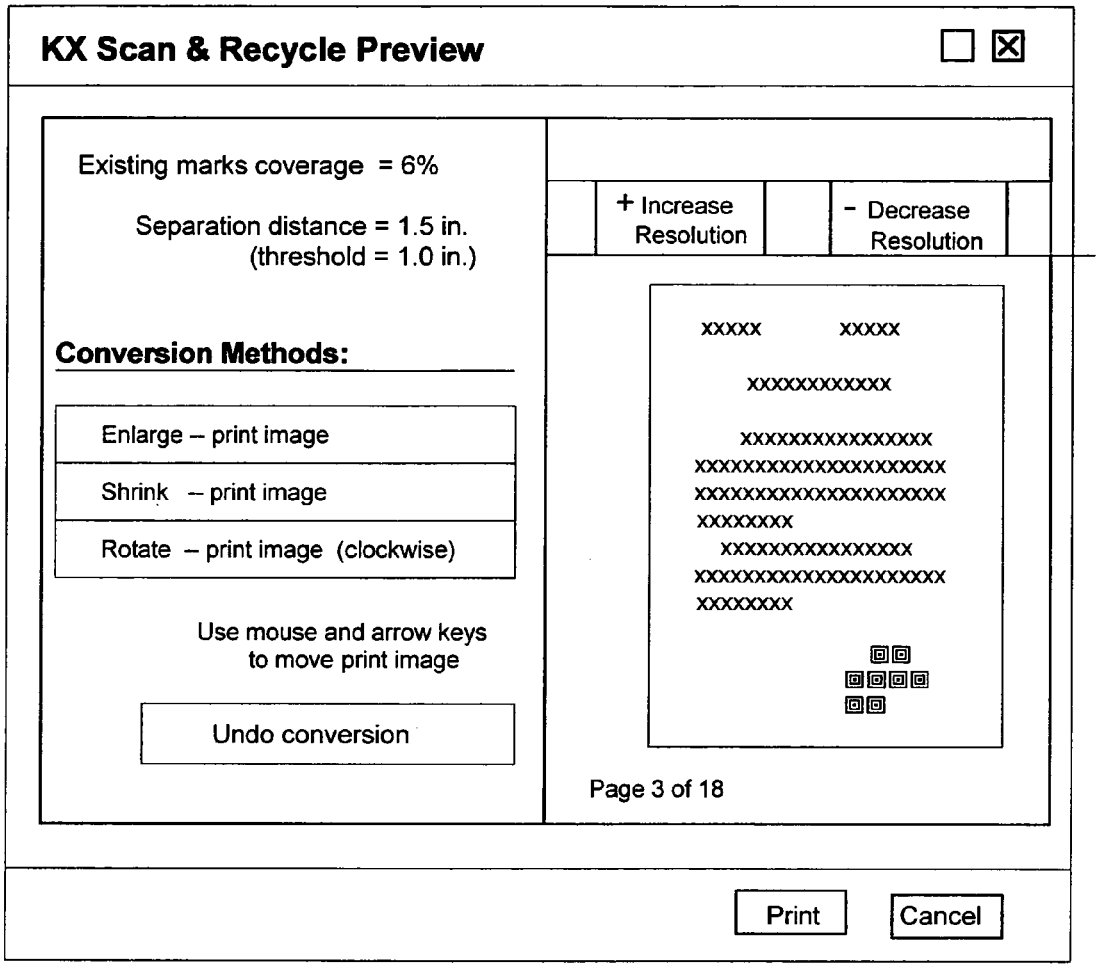
FIG. 4 is a view of the GUI for previewing a print page and for specifying printing, canceling, and converting the print page, in accordance with a preferred embodiment of the present invention.

FIG. 4 is a view of the GUI for previewing a print page and for specifying printing, canceling, and converting the print page, in accordance with a preferred embodiment of the present invention.

On the right side of the window is a preview display for showing the current page. In the enlarged pixels or blocks of the current resolution, the intended print output may be displayed with X's and the existing marks are displayed with doubly-nested squares with central dots. When there is no advantage to display the intended print output in lower-resolution, a normal resolution should be used. Other display schemes that show the intended print output and the existing marks in a visually distinct manner are possible, such as using different colors. The user can use the [+ Increase Resolution] and [− Decrease Resolution] buttons to obtain images of the page in magnified and reduced the resolution.

On the left side of the window is some information about the current settings related to the methods of the invention, such as the coverage of the existing marks within the current page. This figure may be approximate, having only the precision possible with the current resolution being used. Also shown is the separation distance between the intended print output and the existing marks. The user can choose a threshold separation distance, such that if the detected, actual separation distance is smaller than this threshold value, the printing will not proceed without adjustment or the user will be alerted and prompted for confirmation. There can also be a customizable coverage percentage threshold that is similarly triggered and used.

Also on the left side of the window is a list of buttons corresponding to the conversion methods for adjusting the intended print output: enlarging, shrinking, rotating, and moving. The mouse or the arrow keys can be used to move the intended print image or intended print output. After a conversion is performed, the result is shown in the preview display. It is also possible to undo a conversion.

The GUI provides methods for adjusting the parameters for these conversion methods, for example, by right-clicking on the conversion buttons. The parameters for the conversion methods includes how much to enlarge or shrink. The GUI also provides methods for changing the other parameters, such as the separation threshold value.

When the user is satisfied with the appearance of the print page, the user can click on the [Print] button to initiate printing. The user can click on the [Cancel] button to cancel printing of the page.

Figure 5:
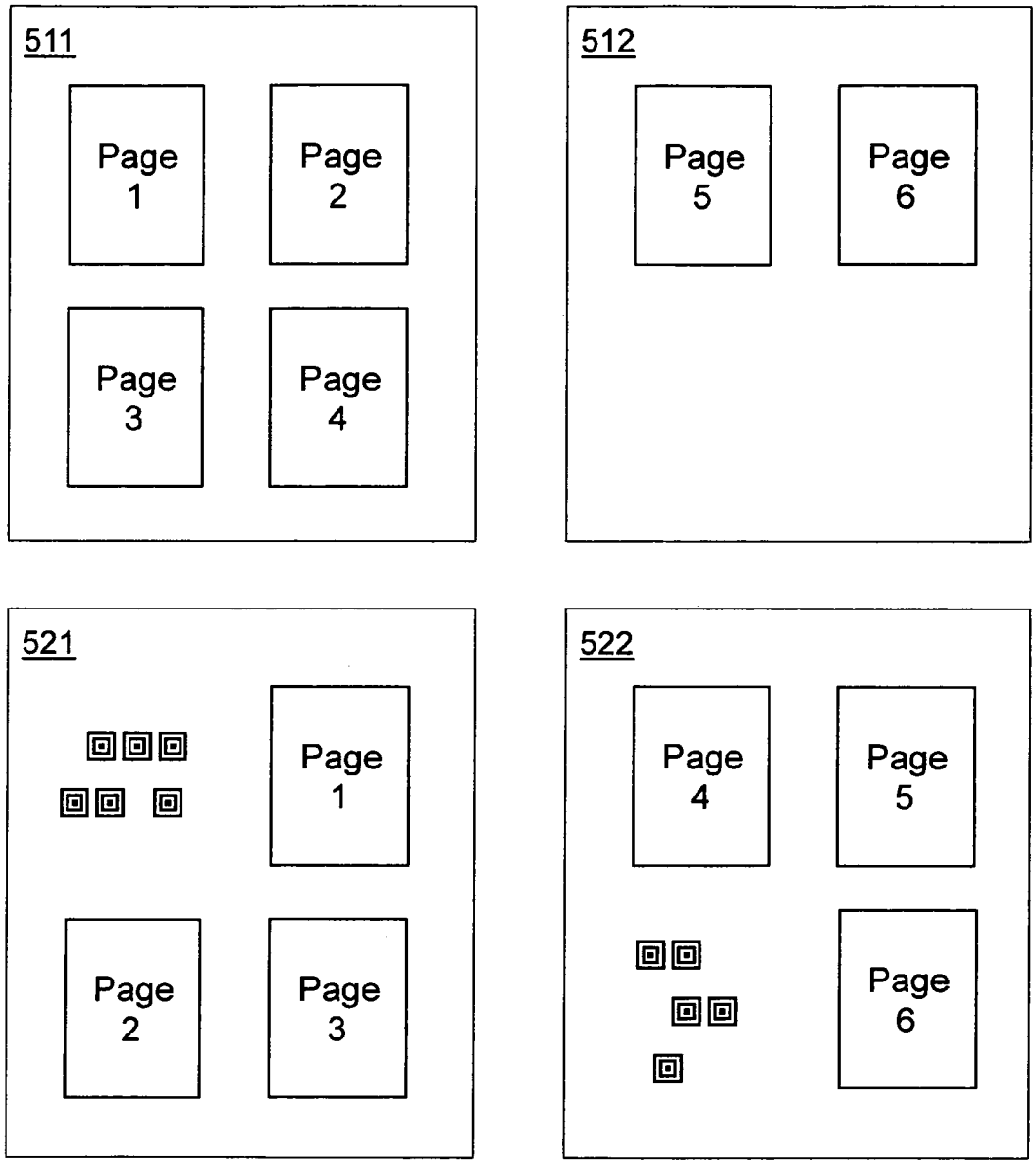
FIG. 5 illustrates methods and examples of N-up printing on recycled paper, in accordance with a preferred embodiment of the present invention.

FIG. 5 illustrates methods and examples of N-up printing on recycled paper, in accordance with a preferred embodiment of the present invention. Using the 4-up printing feature of the printer driver, scaled-down, smaller images of the pages are printed four per sheet. Typically, for a six-page document, the first four pages are printed on the first sheet (or first side) 511 and the next two pages are printed on the second sheet (or second side) 512.

Using an embodiment of the present invention, when some existing marks are detected on the sheet, some scaled-down, smaller images of the pages can be moved to a later sheet. In the figure, the existing marks are displayed with doubly-nested squares with central dots. For example, to avoid printing on top of two small, existing marks, the six scale-down pages can be rearranged so that the order of the printing the scaled-down pages (left-to-right, then up-to-down) is not changed 521, 522. This method can be used with N-up printing in general in a similar manner to the 4-up printing illustration given above, where the scale-down pages can be rearranged so that the ordering schemes of the printing the scaled-down pages (e.g., left-to-right, then up-to-down) are not changed to preserve continuity. It is also possible to rearrange the scaled-down pages in a slightly misaligned manner to avoid overlap with, or to increase the separation distance from, the existing marks.

Figure 6:
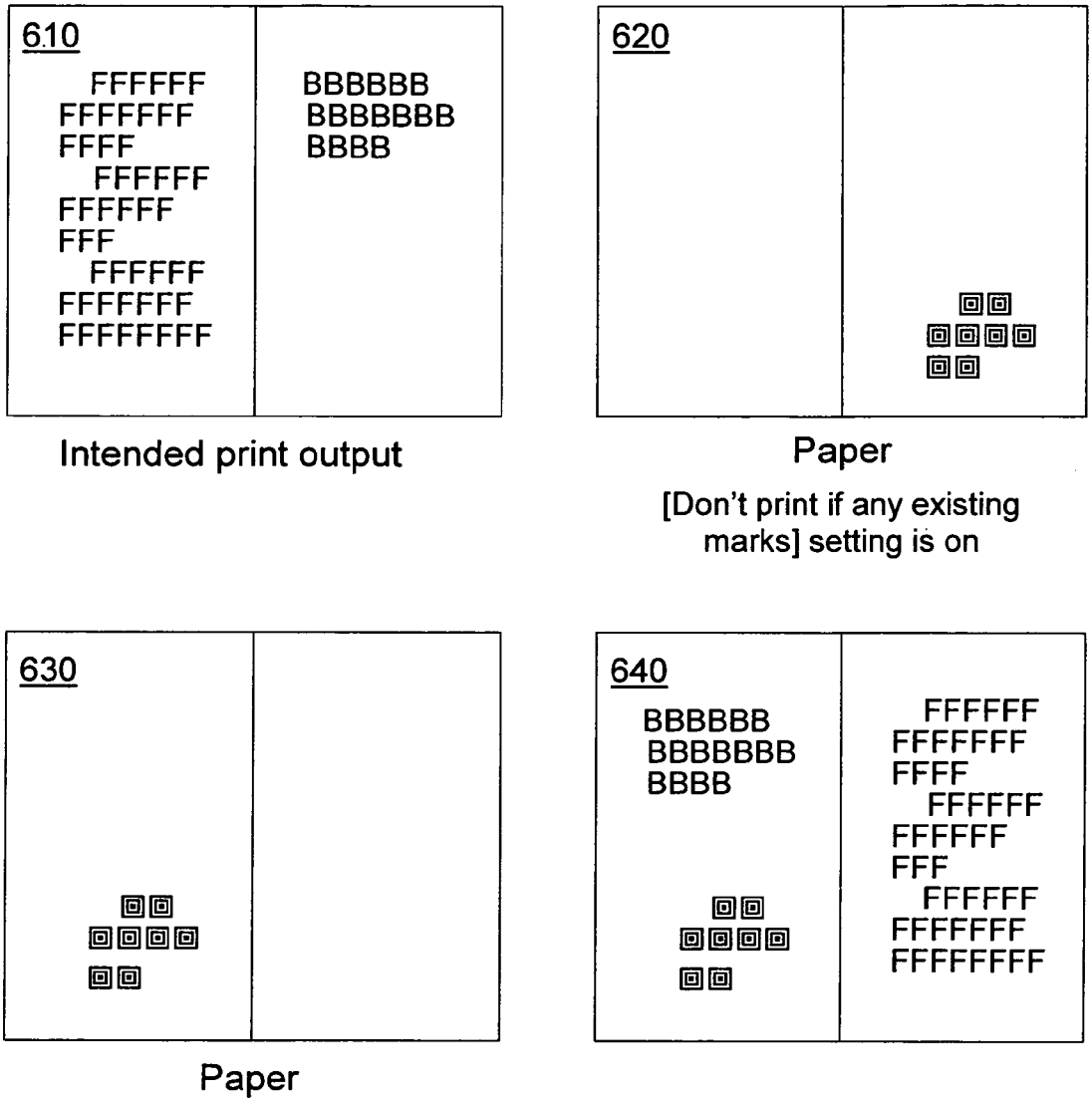
FIG. 6 illustrates methods and examples of Duplex printing on recycled paper, in accordance with a preferred embodiment of the present invention.

FIG. 6 illustrates methods and examples of Duplex printing on recycled paper, in accordance with a preferred embodiment of the present invention. A sample intended print output includes text to be printed on the front side (indicated by a series of F's) and text to be printed on the back side (indicated by a series of B's) 610.

According to an embodiment of the present invention, it is possible to select and set the [Don't print if there are any existing marks] setting or option. When this option is set, then even if it would be possible to print an intended print output 610 to a sheet of paper 620 without causing any collision or overlap, presence of any existing marks on the paper precludes printing to be performed.

When an intended print output 610 cannot be printed to a sheet of paper with some existing marks 630 due to overlap, various adjustment methods of the present invention can be used to make printing more suitable. One possible solution for duplex printing is either to reverse the front and back sides of the paper, or to reverse the front and back sides of the intended print output before printing 640. Unless the user specifies otherwise and unless it is a multiple sheet output, reversing the images is the preferred method, rather than reversing the sheet, for it is easier for the printer mechanically. The user typically does not notice the order of the front and back sides of a printed sheet of a single sheet output.

Figure 7:
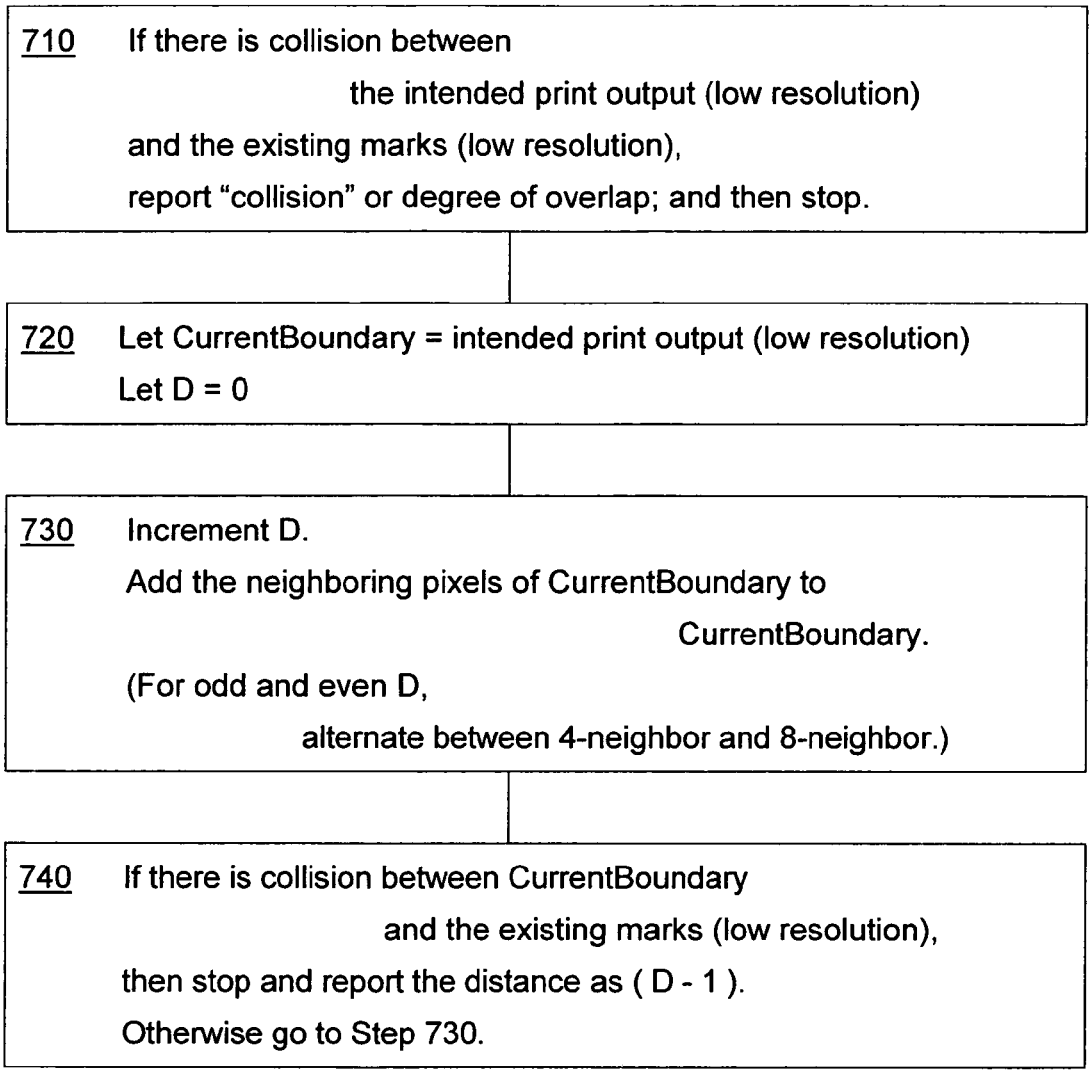
FIG. 7 is a flowchart showing the procedure for estimating the separation distance between the intended print output and the existing marks, in accordance with a preferred embodiment of the present invention.

FIG. 7 is a flowchart showing the procedure for estimating the separation distance between the intended print output and the existing marks, in accordance with a preferred embodiment of the present invention.

In step 710, collision or overlap between the intended print output and the existing marks is examined. In most cases this detection requires only an approximate result. For example, if there is much overlap, the user would not want to have the print output printed on the sheet, but a user may not care about the difference between a slight overlap and no overlap.

Both for the collision or overlap detection and detection of separation distance, described below, only a low-resolution image is required. A low-resolution image is typically one in which a square is indicated to contain something (as opposed to represent a blank space) if there is any marks or pixels (or even a single mark or pixel) in the corresponding area. Using low-resolution images achieves the dual purposes of saving communication bandwidth between the scanning unit (Scanner) and the processing unit (PC), as well as avoiding the processing by the processing unit to slow down too much. Note that using low resolution images in this way always fails on the safe side. That is, it is possible that a false detection of collision is made in a near-miss situation, but where there is actual collision, it is impossible to fail to detect it.

If there a collision or overlap is detected, then that fact and the degree of overlap are reported. The degree of overlap is, typically, a simple number representing the number of low-resolution pixels that are overlapped between the print output and the existing marks. In an embodiment of the invention, the user may specify the threshold to trigger withholding of printing or requirement of user confirmation.

If there is no overlap, then the procedure next tries to estimate the separation distance between the intended print output and the existing marks. The procedure may not be required to proceed any further when beyond this point if the user specifies that all that is required is the existence of overlap and/or the degree of overlap.

Starting in step 720, the separation distance between the intended print output and the existing marks is examined. The separation distance here is the shortest distance that separates the two regions. Again, in most cases this detection requires only an approximate result. For example, the user typically does not care if the regions are separated by 2 inches or 2.1 inches. The variable Current Boundary stores the aggregate or combination of the original print output and the growing layers of neighboring pixels. The Current Boundary is first set to the low-resolution intended print output, and D is set to 0.

In step 730, first, D is incremented. Then, the neighboring pixels of the Current Boundary are added to the Current Boundary. The neighboring pixels of a pixel are typically the four neighbors or the eight neighboring pixels surrounding the pixel. In an embodiment of the invention, alternating 4-neighbor and 8-neighbor schemes can be used, which is described further below in connection with FIG. 8 and FIG. 9.

In step 740, if there is a collision or overlap between the Current Boundary and the existing marks (both in low resolution mode), then the process of this flowchart is stopped and the separation distance is reported as (D−1) pixels. Otherwise the control goes to Step 730 and the process continues.

Figure 8:
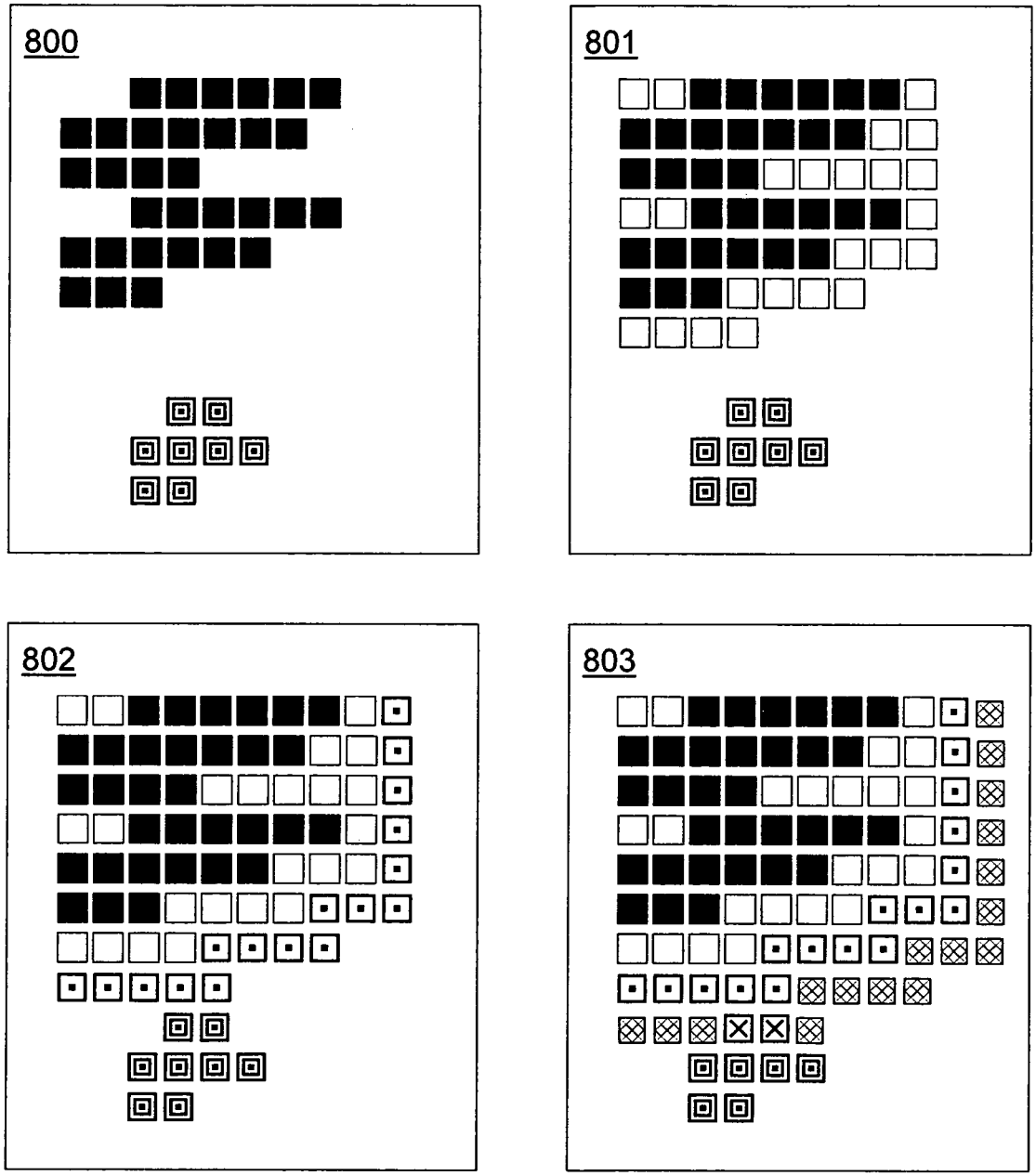
FIG. 8 illustrates methods, examples, and steps in estimating the separation distance between the intended print output and the existing marks, in accordance with a preferred embodiment of the present invention.

FIG. 8 illustrates methods, examples, and steps in estimating the separation distance between the intended print output and the existing marks, in accordance with a preferred embodiment of the present invention. A sample low-resolution preview 800 of the intended print output and the existing marks include intended print output indicated by solid black blocks and the existing marks indicated by blocks each of which has a pattern of doubly-nested squares around a central dot.

First, all the neighboring pixels of distance D=1 are marked as such. In the sample preview, these blocks are represented by framed boxes that are empty inside 801.

Then all the neighboring pixels of distance D=2 are marked as such. In the sample preview, these blocks are represented by framed boxes that have central dots 802.

Finally, all the neighboring pixels of distance D=3 are marked as such. In the sample preview, these blocks are represented by framed boxes with diagonal lines inside 803. At this point, collision or overlap is detected between the Current Boundary (the aggregate of the original print output and the neighboring pixels) and the existing marks. The two overlapped blocks are represented by framed boxes containing X's 803. Since the overlap first occurred at distance D=3, the separation distance between the intended print output and the existing marks has been determined to be 2.

Figure 9:
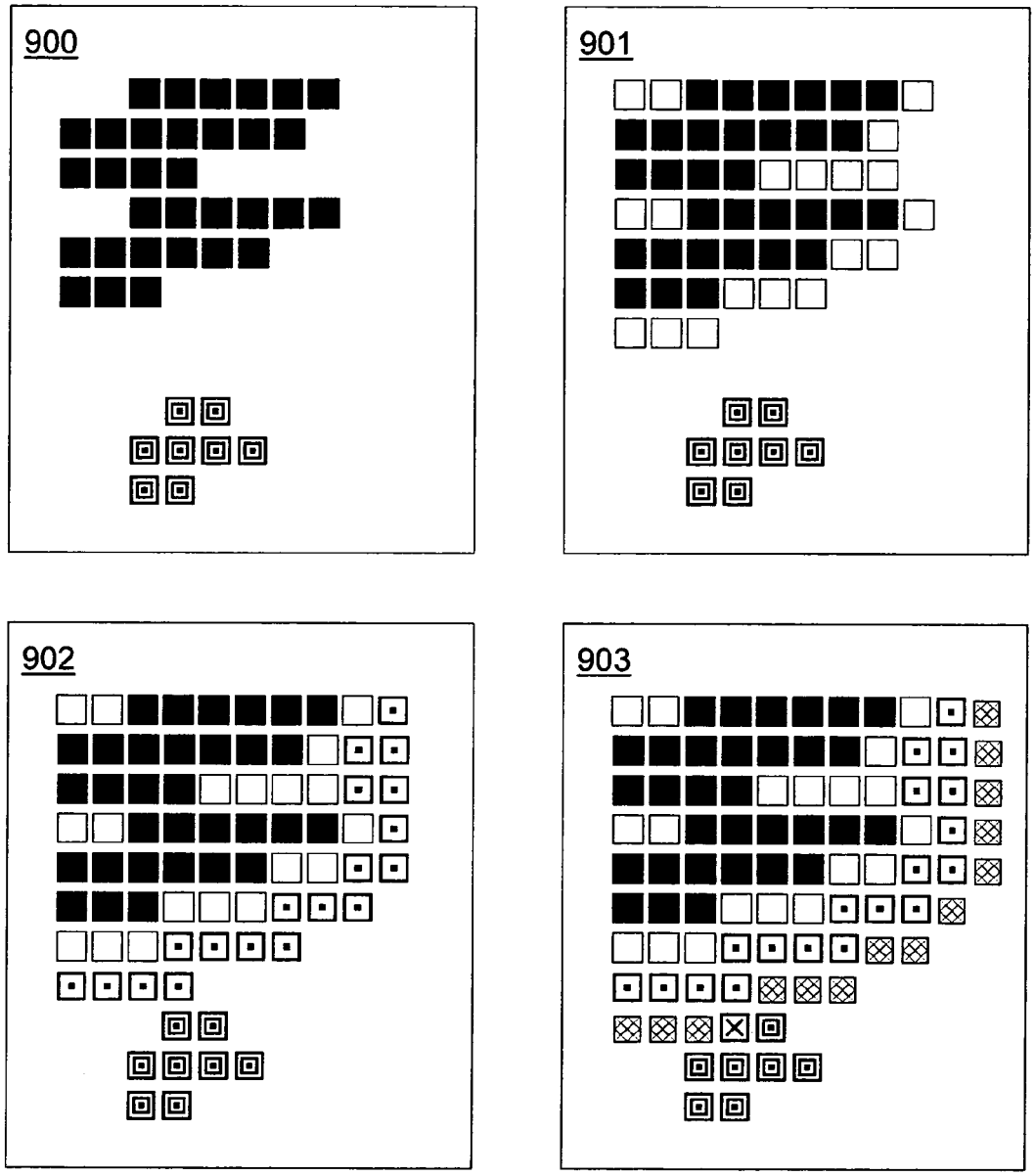
FIG. 9 illustrates methods, examples, and steps in estimating the separation distance between the intended print output and the existing marks using alternating 4- and 8-neighbors, in accordance with a preferred embodiment of the present invention.

FIG. 9 illustrates methods, examples, and steps in estimating the separation distance between the intended print output and the existing marks using alternating 4- and 8-neighbors, in accordance with a preferred embodiment of the present invention.

In the above example of FIG. 8 which used an 8-neighbor scheme, a box is deemed to have 8 neighboring boxes. The problem with this scheme is that the Current Boundary grows too fast in the diagonal directions, which can be seen from the example, resulting in under-reporting of the separation distance. An alternative is to use a 4-neighbor scheme, in which a box is deemed to have 4 neighboring boxes in the vertical and horizontal directions. The problem with this scheme is that the Current Boundary grows too slowly in the diagonal directions (not shown in the example). Therefore, a better alternative is to use a scheme involving alternating 4-neighbors and 8-neighbors, for odd and even D. Starting from a single box, the boundary grows in a diamond shape in the 4-neighbor scheme, in a square shape in the 8-neighbor scheme, and in an octagon shape in the alternating 4-neighbor and 8-neighbor scheme. This octagon thus formed is much closer to the circle (showing true distance) than the diamond or the square.

A sample low-resolution preview 900 of the intended print output and the existing marks include intended print output indicated by solid black blocks and the existing marks indicated by blocks each of which has a pattern of doubly-nested squares around a central dot. This is identical to the previous example 800.

First, all the neighboring pixels of distance D=1 are marked as such. In the sample preview, these blocks are represented by framed boxes that are empty inside 901. Unlike in the previous example 801, the 4-neighbors are included and added to the Current Boundary 901.

Then all the neighboring pixels of distance D=2 are marked as such. In the sample preview, these blocks are represented by framed boxes that have central dots 902. For even D=2, 8-neighbors are included and added to the Current Boundary 902.

Finally, all the neighboring pixels of distance D=3 are marked as such. In the sample preview, these blocks are represented by framed boxes with diagonal lines inside 903. For odd D=3, 4-neighbors are included and added to the Current Boundary 903. At this point, collision or overlap is detected between Current Boundary (the aggregate of the original print output and the neighboring pixels) and the existing marks. The one overlapped block is represented by a framed box containing an X 903.

Since the overlap first occurred at distance D=3, the separation distance between the intended print output and the existing marks has been determined to be 2. The detected separation distance is the same as in the previous example, but the difference from the previous example is that the overlap comprises of only one block, represented by a framed box containing an X 803. This is a result of the more accurate separation distance estimation accomplished by using the scheme involving alternating 4- and 8-neighbors.

Although this invention has been largely described using terminology pertaining to printer drivers, one skilled in this art could see how the disclosed methods can be used with other device drivers. The foregoing descriptions used printer drivers rather than general device drivers for concreteness of the explanations, but they also apply to other device drivers. Similarly, the foregoing descriptions of the preferred embodiments generally use examples pertaining to printer driver settings, but they are to be understood as similarly applicable to other kinds of device drivers.

Although this invention has been largely described using Windows terminology, one skilled in this art could see how the disclosed methods can be used with other operating systems, such as DOS, Unix, Linux, Palm OS, or Apple OS, and in a variety of devices, including personal computers, network appliance, handheld computer, personal digital assistant, handheld and multimedia devices, etc. One skilled in this art could also see how the user could be provided with more choices, or how the invention could be automated to make one or more of the steps in the methods of the invention invisible to the end user.

While this invention has been described in conjunction with its specific embodiments, it is evident that many alternatives, modifications and variations will be apparent to those skilled in the art. There are changes that may be made without departing from the spirit and scope of the invention.

Any element in a claim that does not explicitly state "means for" performing a specific function, or "step for" performing a specific function, is not to be interpreted as a "means" or "step" clause as specified in 35 U.S.C. 112, Paragraph 6. In particular, the use of "step(s) of" or "method step(s) of" in the claims herein is not intended to invoke the provisions of 35 U.S.C. 112, Paragraph 6.

What is claimed is:

1. A method for printing to a paper sheet, comprising scanning the paper sheet for at least zero existing marks;

comparing an intended output and the at least zero existing marks to detect an overlap between the intended output and the at least zero existing marks;

printing the intended output to the paper sheet upon determining the suitability of printing the intended output to the paper sheet, wherein comparing of an intended output and the at least zero existing marks comprises determining printing the intended output to the paper sheet suitable if a detected separation distance between the intended output and the at least zero existing marks is greater than the user-customizable, threshold separation-distance value, wherein the detected separation distance is detected by estimating the separation distance between a low-resolution image of the intended output and a low-resolution image of the at least zero existing marks.

2. The method of claim 1, further comprising, before printing the intended output to the paper sheet, reversing the paper sheet to scan the reverse side of the paper sheet to determine the suitability of printing the intended output to the reverse side of the paper sheet;

rotating the paper sheet to determine the suitability of printing the intended output to the rotated paper sheet; and discarding the paper sheet to determine the suitability of printing the intended output to the next paper sheet in a paper bin of a printer.

3. The method of claim 1, further comprising, before printing the intended output to the paper sheet, adjusting the intended output to make the intended output more suitable for printing to the paper sheet, by shrinking the intended output, moving the intended output, and rotating the intended output.

4. The method of claim 1, further comprising displaying the intended output and the at least zero existing marks in a preview and confirmation display, optionally displaying the intended output and the at least zero existing marks in visually distinct manners, wherein the scanning of the paper sheet for at least zero existing marks and displaying of the at least zero existing marks is done in a low-resolution mode.

5. The method of claim 1, wherein the printing of the intended output to the paper sheet further comprises printing at least zero shading patterns on the at least zero existing marks.

6. The method of claim 1, further comprising, before printing the intended output to the paper sheet, adjusting the intended output to make the intended output more suitable for printing to the paper sheet, by rearranging at least one scaled-down page image of N-up printing format of the intended output to avoid collision of the at least one scaled-down page image and the at least zero existing marks on the paper sheet.

7. The method of claim 1, further comprising, before printing the intended output to the paper sheet, adjusting the intended output and orientation of the paper sheet to make the intended output more suitable for printing to the paper sheet, by exchanging front-side and back-side images printed on front-side and back-side of the paper sheet to avoid collision of the intended output and the at least zero existing marks on the paper sheet.

8. The method of claim 1, wherein estimating of the separation distance between the low-resolution image of the intended output and a low-resolution image of the at least zero existing marks comprises gradually increasing a boundary by starting from the low-resolution image of the intended output, and adding to the boundary the alternating 4-neighbors and 8-neighbors of the boundary, until a collision is detected between the boundary and the low-resolution image of the at least zero existing marks.

9. A computer program product for printing to a paper sheet, comprising machine-readable code for causing a machine to perform the method steps of:

scanning the paper sheet for at least zero existing marks;

comparing an intended output and the at least zero existing marks to detect an overlap between the intended output and the at least zero existing marks;

printing the intended output to the paper sheet upon determining the suitability of printing the intended output to the paper sheet, wherein comparing of an intended output and the at least zero existing marks comprises determining printing the intended output to the paper sheet suitable if a degree of overlap between the intended output and the at least zero existing marks is less than the user-customizable, threshold overlap value; and wherein comparing of an intended output and the at least zero existing marks comprises determining printing the intended output to the paper sheet suitable if a detected separation distance between the intended output and the at least zero existing marks is greater than the user-customizable, threshold separation-distance value, wherein the detected separation distance is detected by estimating the separation distance between a low-resolution image of the intended output and a low-resolution image of the at least zero existing marks.

10. The computer program product of claim 9, wherein printing of the intended output to the paper sheet further comprises printing at least zero shading patterns on the at least zero existing marks; and further comprising machine-readable code for causing a machine to perform, before printing the intended output to the paper sheet, the method steps of:

reversing the paper sheet to scan the reverse side of the paper sheet to determine the suitability of printing the intended output to the reverse side of the paper sheet;

rotating the paper sheet to determine the suitability of printing the intended output to the rotated paper sheet;

discarding the paper sheet to determine the suitability of printing the intended output to the next paper sheet in a paper bin of a printer; and adjusting the intended output to make the intended output more suitable for printing to the paper sheet, by shrinking the intended output, moving the intended output, and rotating the intended output.

11. The computer program product of claim 9, further comprising the method step of displaying the intended output and the at least zero existing marks in a preview and confirmation display, optionally displaying the intended output and the at least zero existing marks in visually distinct manners, wherein the scanning of the paper sheet for at least zero existing marks and displaying of the at least zero existing marks is done in a low-resolution mode.

12. The computer program product of claim 9, further comprising machine-readable code for causing a machine to perform, before printing the intended output to the paper sheet, the method steps of:

adjusting the intended output to make the intended output more suitable for printing to the paper sheet, by rearranging at least one scaled-down page image of N-up printing format of the intended output to avoid collision of the at least one scaled-down page image and the at least zero existing marks on the paper sheet; and adjusting the intended output and orientation of the paper sheet to make the intended output more suitable for printing to the paper sheet, by exchanging front-side and back-side images printed on front-side and back-side of the paper sheet to avoid collision of the intended output and the at least zero existing marks on the paper sheet.

13. The computer program product of claim 9, wherein estimating of the separation distance between the low-resolution image of the intended output and a low-resolution image of the at least zero existing marks comprises gradually increasing a boundary by starting from the low-resolution image of the intended output, and adding to the boundary the alternating 4-neighbors and 8-neighbors of the boundary, until a collision is detected between the boundary and the low-resolution image of the at least zero existing marks.

14. A computing system comprising a print engine, programmed to print to a paper sheet, comprising:

scanning the paper sheet for at least zero existing marks;

comparing an intended output and the at least zero existing marks to detect an overlap between the intended output and the at least zero existing marks;

printing the intended output to the paper sheet upon determining the suitability of printing the intended output to the paper sheet, wherein comparing of an intended output and the at least zero existing marks comprises determining printing the intended output to the paper sheet suitable if a degree of overlap between the intended output and the at least zero existing marks is less than the user-customizable, threshold overlap value and wherein comparing of an intended output and the at least zero existing marks comprises determining printing the intended output to the paper sheet suitable if a detected separation distance between the intended output and the at least zero existing marks is greater than the user-customizable, threshold separation-distance value, wherein the detected separation distance is detected by estimating the separation distance between a low-resolution image of the intended output and a low-resolution image of the at least zero existing marks.

15. The computing system of claim 14, wherein printing of the intended output to the paper sheet further comprises printing at least zero shading patterns on the at least zero existing marks; and further comprising, before printing the intended output to the paper sheet:

reversing the paper sheet to scan the reverse side of the paper sheet to determine the suitability of printing the intended output to the reverse side of the paper sheet;

rotating the paper sheet to determine the suitability of printing the intended output to the rotated paper sheet;

discarding the paper sheet to determine the suitability of printing the intended output to the next paper sheet in a paper bin of a printer; and adjusting the intended output to make the intended output more suitable for printing to the paper sheet, by shrinking the intended output, moving the intended output, and rotating the intended output.

16. The computing system of claim 14, further comprising displaying the intended output and the at least zero existing marks in a preview and confirmation display, optionally displaying the intended ouptut and the at least zero existing marks in visually distinct manners, wherein the scanning of the paper sheet for at least zero existing marks and displaying of the at least zero exisitng marks is done in a low-resolution mode.

17. The computing system of claim 14, further comprising, before printing the intended output to the paper sheet:

adjusting the intended output to make the intended output more suitable for printing to the paper sheet, by rearranging at least one scaled-down page image of the N-up printing format of the intended output to avoid collision of the at least one scaled-down page image and the at least zero existing marks on the paper sheet; and adjusting the intended output and orientation of the paper sheet to make the intended output more suitable for printing to the paper sheet, by exchanging front-side and back-side images printed on front-side and back-side of the paper sheet to avoid collision of the intended output and the at least zero existing marks on the paper sheet.

18. The computing system of claim 14, wherein estimating of the separation distance between the low-resolution image of the intended output and a low-resolution image of the at least zero existing marks comprises gradually increasing a boundary by starting from the low-resolution image of the intended output, and adding to the boundary the alternating 4-neighbors and 8-neighbors of the boundary, until a collision is detected between the boundary and the low-resolution image of the at least zero existing marks.

* * * * *